US007261588B2

(12) United States Patent
Yokoyama

(10) Patent No.: US 7,261,588 B2
(45) Date of Patent: Aug. 28, 2007

(54) CONNECTOR HAVING A LEVER FOR OPENING AND CLOSING UPPER AND LOWER ARMS OF FORKED CONTACT MEMBERS

(75) Inventor: Hiromasa Yokoyama, Yokohama (JP)

(73) Assignee: J.S.T. Mfg. Co., Ltd., Osaka (JP)

( * ) Notice: Subject to any disclaimer, the term of this patent is extended or adjusted under 35 U.S.C. 154(b) by 0 days.

(21) Appl. No.: 10/571,393

(22) PCT Filed: Sep. 22, 2004

(86) PCT No.: PCT/JP2004/013846

§ 371 (c)(1),
(2), (4) Date: Mar. 9, 2006

(87) PCT Pub. No.: WO2005/031925

PCT Pub. Date: Apr. 7, 2005

(65) Prior Publication Data

US 2006/0270270 A1 Nov. 30, 2006

(30) Foreign Application Priority Data

Sep. 26, 2003 (JP) ..... 2003-336573

(51) Int. Cl.
*H01R 12/24* (2006.01)

(52) U.S. Cl. ..... 439/495; 439/267

(58) Field of Classification Search ..... 439/260, 439/495, 267

See application file for complete search history.

(56) References Cited

U.S. PATENT DOCUMENTS 6,726,497 B2 * 4/2004 Nogawa et al. ..... 439/260
6,755,682 B2 * 6/2004 Kunishi et al. ..... 439/495
6,997,729 B2 * 2/2006 Sunaga ..... 439/260

FOREIGN PATENT DOCUMENTS

JP 07-018386 U 3/1995
JP 3019279 U 12/1995
JP 10-208810 A 8/1998

(Continued)

OTHER PUBLICATIONS

International Search Report.

*Primary Examiner*—Tulsidas C. Patel
*Assistant Examiner*—Harshad C Patel
(74) *Attorney, Agent, or Firm*—Rader, Fishman & Grauer PLLC

(57) ABSTRACT

The present invention provides a connector including: an approximately box-shaped housing having an insertion opening for the insertion of an FPC; forked contact members provided within the housing; and a lever which is provided so as to face the insertion opening of the housing, and which is turnably held by the housing. With such an arrangement, the forked contact member includes a base, an upper arm and a lower arm, and a forked engaging arm. The tip of the lower arm is held by the housing. The lever includes a holding portion, a rotational shaft, and first plate cams. Upon raising the lever, the distance between the tips of each of the forked engaging arms is increased by the actions of the first plate cam, thereby increasing the distance between the upper arm and the lower arm of each of the forked contact members.

7 Claims, 6 Drawing Sheets

FOREIGN PATENT DOCUMENTS

| | | | |
|---|---|---|---|
| JP | 11-031561 | A | 2/1999 |
| JP | 11-185896 | A | 7/1999 |
| JP | 11-307198 | A | 11/1999 |
| JP | 2000-058173 | A | 2/2000 |
| JP | 2000-206897 | A | 7/2000 |
| JP | 2000-208061 | A | 7/2000 |
| JP | 2000-208179 | A | 7/2000 |
| JP | 2000-260507 | A | 9/2000 |
| JP | 2000-315535 | A | 11/2000 |
| JP | 2000-315536 | A | 11/2000 |
| JP | 2001-006778 | A | 1/2001 |
| JP | 2001-015196 | A | 1/2001 |
| JP | 2001-035576 | A | 2/2001 |
| JP | 2001-076794 | A | 3/2001 |
| JP | 2001-126793 | A | 5/2001 |
| JP | 2002-033150 | A | 1/2002 |
| JP | 2002-042939 | A | 2/2002 |
| JP | 2002-252049 | A | 9/2002 |
| JP | 2002-252061 | A | 9/2002 |
| JP | 2002-252067 | A | 9/2002 |
| JP | 2002-270290 | A | 9/2002 |
| JP | 2003-100370 | A | 4/2003 |
| JP | 2004-221067 | A | 8/2004 |
| JP | 2004-342426 | A | 12/2004 |

* cited by examiner

CONNECTOR HAVING A LEVER FOR OPENING AND CLOSING UPPER AND LOWER ARMS OF FORKED CONTACT MEMBERS

TECHNICAL FIELD

The present invention relates to a connector for connecting a flat flexible cable such as an FPC (Flexible Printed Circuit), FFC (Flexible Flat Cable), etc. In particular, the present invention relates to a connector which enables the user to insert a flat flexible cable such as an FPC, FFC, etc., with almost zero insertion force.

BACKGROUND ART

An FPC includes a great number of terminals in parallel. The FPC having such a structure is detachably connected to a printed board using a connector including a great number of contacts provided in parallel. Conventional connectors are known as disclosed in Patent Documents 1, 2, etc., in which the contact members and the terminals of the FPC are pressed in contact with each other through an operating member so as to connect the great number of terminals with the contact members all at the same time, thereby the FPC is held in a sure manner.

A connector disclosed in Patent Document 1 includes a housing having a structure in which an FPC insertion opening is formed on one face thereof for the insertion of an FPC, and a cover insertion opening is formed on the other face thereof for the insertion of a cover. On the other hand, each contact member includes a pressing piece provided so as to face the cover insertion opening, which is elastically deformable by insertion of the cover, and a pressure-contact piece provided so as to face the FPC insertion opening, which contacts to the FPC corresponding to the elastically deformation of the pressing piece during the insertion of the cover.

With such an arrangement, upon inserting the cover into the cover insertion opening formed on the other face of the housing after the insertion of the FPC into the FPC insertion opening formed on one face of the housing, the pressing piece of each contact member is elastically deformed. This action presses the pressure-contact piece of the contact member into contact with the FPC. Thus, the FPC is pressed into contact with, and is connected with, the contact members.

On the other hand, a connector disclosed in Patent Document 2 includes: an insulating housing; and a cover provided at the upper portion of the rear end of the insulating housing, the cover can turn in the back and forth direction of the insulating housing. The insulating housing has a structure in which an insertion opening is provided at the front end thereof for the insertion of a flat flexible cable. Furthermore, multiple electroconductive terminals (contact members) are provided in parallel within the housing such that contact beams thereof face the insertion opening. Each of the electroconductive terminals (contact members) has a base beam and a U-shaped contact beam connected with one another through a connection portion so as to form a single unit. An engaging arm is provided at the rear end of each base beam. Alongside, a lever arm is provided at the rear end of each contact beam. An engaging portion formed of the engaging arms of the multiple electroconductive terminals (contact members) provided in parallel and another engaging portion of the cover are engaged with one another in a manner which allows the cover to turn. Furthermore, the lever arm and the cover are provided such that the lever arm and the inner face of the cover face one another at the rear end of the cover. Such a structure allows the portion facing the U-shaped contact beam to be opened and closed by turning the cover using the lever arm.

With such a structure, upon turning the cover, the inner face of the cover moves the lever arm. Then, the movement of the lever opens or closes the contact beams of the electroconductive terminals (contact members). After the opening of the contact beams, the user can insert the connection terminal of a flat flexible cable into the insertion opening with zero insertion force. Upon closing the contact beams, between the contact beams and the flat flexible cable a certain contact pressure is produced due to the elasticity of the contact beams. With such an arrangement, the opening and closing of the contact beams are performed by actions of the lever arms. This enables the user to turn the cover without large insertion force.

[Patent Document 1] Japanese Unexamined Utility Model Registration Application Publication No. 7-18386

[Patent Document 2] Japanese Registration Utility Model No. 3019279

However, the connector disclosed in Patent Document 1 has a problem as follows. With the connector disclosed in Patent Document 1, the pressing piece of each contact member is elastically deformed. This elastic deformation presses the pressure-contact piece of each contact member into contact with the FPC. This means that stress is applied to each contact member during connection of the FPC with the connector. This causes creep, for example, leading to deterioration in the durability of the connector. Furthermore, since the cover is inserted into the cover insertion opening from above the housing for elastically deforming the pressing portions, the upper wall of the housing has an increased thickness. This leads to an increase in thickness of the upper wall of the connector.

On the other hand, the connector disclosed in Patent Document 2 has a problem as follows. The cover is turned while engaging the engaging portion, which is formed of lever arms disposed in parallel on the rear side of the electroconductive terminals (contact members), with the engaging portion of the cover. With such a structure, stress is applied to the lever arms disposed at the rear side of the electroconductive terminals (contact members) every time the user opens or closes the cover. This causes deterioration in the durability of the connector. In addition, the cover is not engaged with the housing. In some cases, this leads to undesirable disengagement of the FPC from the connector. Furthermore, the contact member has a structure in which a lever arm and an engaging arm are formed on the rear side thereof. With such a structure, upon turning the cover with the engaging arm and the engaging portion of the cover being engaged with other, the cover presses down the lever arm. Such a contact member requires a three-layer structure in which three components are arranged one above another, leading to an increased mounting height of the connector.

In particular, the use of connectors in cellular phones, digital still cameras (DSC, DVC), etc., in recent years has required a small mounting height of around 1 mm, for example.

In view of the aforementioned problems, it is an object of the present invention to provide a connector with a reduced mounting height, i.e., reduced-height connector having a function of maintaining the opening and closing states of a back lock lever serving as a cover in a sure manner while improving the durability of contact members.

DISCLOSURE OF THE INVENTION

In order to solve the aforementioned problems, the inventor has provided a new connector as follows.

In a first aspect of the present invention, a connector includes: an approximately box-shaped housing having an insertion opening for the insertion of an FPC; forked contact members provided within the housing; and a lever which is provided so as to face the insertion opening of the housing, and which is turnably held by the housing, wherein the forked contact member includes a base, an upper arm and a lower arm extending approximately parallel with each other from the base toward the insertion opening, and a forked engaging arm provided so as to extend from the base in the direction opposite to the insertion opening, in which the tip of the lower arm is held by the housing, in which the lever includes a holding portion, a rotational shaft which is provided to the holding portion, and which is held by the housing, and first plate cams which are provided to the rotational shaft, and which are engaged with the engaging arms, and in which, upon raising the holding portion, the distance between the tips of each of the forked engaging arms is increased by the actions of the first plate cam, thereby increasing the distance between the upper arm and the lower arm of each of the forked contact members.

Upon raising the holding portion, the distance between the tips of the engaging arm of each forked contact member is increased by actions of the first plate cam. This action increases the distance between the upper arm and the lower arm of each forked contact member. Then, upon pressing down the holding portion after the insertion of an FPC, the distance between the tips of the engaging arm of each forked contact member is returned to the initial distance by actions of the first plate cam. The upper arm and the lower arm of each forked contact member are returned to the initial state due to the elasticity thereof. In this state, the FPC is held by the elastic force of the forked contact members, thereby maintaining the connection state of the FPC. Therefore, upon raising the holding portion, the distance between the upper arm and the lower arm of each forked contact member is increased. Making the distance greater than the thickness of an FPC to be inserted into the space between the upper arms and the lower arms of the forked contact members, it enables inserting and extracting the FPC with a slight application of force.

As described above, the connector according to the present invention has a structure which allows the increase of the distance between the upper arm and the lower arm of each forked contact member by turning and raising the holding portion. In the state in which the distance between the upper arm and the lower arm of each forked contact member is set to be larger, insertion of the FPC requires almost zero force. Upon turning and pressing down the holding portion after the insertion of the FPC, the upper arm of each forked contact member is returned to the initial state by the elasticity of each forked contact member, which enables the FPC to be held while maintaining the connection state thereof. With such an arrangement, external stress is not applied to each forked contact member while the FPC is in a connected state. This improves the durability of the contact members.

Furthermore, the forked contact member has a two-layer structure in which an upper arm and a lower arm are formed with one above the other. This provides the forked contact member with a reduced height, thereby enabling the height of the connector to be reduced. Furthermore, with such an arrangement, the contact tab of each of the forked contact members is disposed in front of the lower arm of each forked contact member. This enables the holding portion to be easily held during the lever opening and closing operation without interference from the contact tabs and so forth. This facilitates the lever opening and closing operation.

In a second aspect of the connector as described in the first aspect of the present invention, the housing includes a pair of connection tabs for connection to a printed board, embedded in both side ends thereof with the insertion opening introduced therebetween, the contact tabs hold both ends of the rotational shaft turnably.

According to the present invention, the housing is connected to the printed board through the connection tabs embedded in both side ends of the housing. Furthermore, the rotational shaft of the lever is turnably held by the connection tabs. The connection tabs press fitted to the housing have two functions. One is the function of fixing the connector to the printed board. The other is the function of turnably holding both ends of the rotational shaft. Such an arrangement including the connection tabs having these two functions allows the connector to have a compact structure.

In a third aspect of the connector as described in the first aspect of the present invention, the rotational shaft is formed of rigid metal, in which the holding portion is formed of an insulating material, and in which the rotational shaft and the holding portion are formed as a single unit.

According to the present invention, since the rotational shaft is formed of rigid metal, it enables suppressing deflection of the rotational shaft at the time of raising and lowering the holding portion. Note that an arrangement may be made in which the exposed metal face of the rotational shaft is coated with an insulating film after formation of the rotational shaft and the holding portion as a single unit.

In a fourth aspect of the connector as described in the first through third aspects of the present invention, the lever includes second plate cams which are provided to the rotational shaft, and which are engaged with the housing.

According to the present invention, the second plate cams are provided such that they are attached to the housing. This stably maintains the state in which the lever is closed. An arrangement employing such a connector has the advantage of preventing undesirable rising of the lever, thereby maintaining the connection state of the FPC.

In a fifth aspect of the connector as described in the fourth aspect of the present invention, the first plate cams and the second plate cams are alternately disposed along the axial direction of the rotational shaft.

According to the present invention, the second plate cams alternately disposed along the axis of the rotational shaft are provided such that they are attached to the housing. This allows the lever to be raised and lowered while suppressing deflection of the rotational shaft thereof.

In a sixth aspect of the connector as described in the first aspect of the present invention, having a space around the handle portion of the lever, which enables the handle portion to be held by hand.

According to the present invention, there is a space around the upper open end portion of the housing, which enables holding the back lock lever. This enables easily holding the holding portion without interference at the time of lever opening and closing operation, thereby facilitating the lever opening operation.

Advantages

A connector according to the present invention includes: an approximately box-shaped housing having an insertion opening for the insertion of an FPC; forked contact members provided within the housing; and a lever which is provided so as to face the insertion opening of the housing, and which is turnably held by the housing. The forked contact member includes a base, an upper arm and a lower arm extending approximately parallel with each other from the base toward the insertion opening, and a forked engaging arm provided so as to extend from the base in the direction opposite to the insertion opening. The tip of each lower arm is held by the housing. The lever includes a holding portion, a rotational shaft which is provided to the holding portion and which is held by the housing, and first plate cams which are provided to the rotational shaft, and which are engaged with the engaging arms. With such an arrangement, upon raising holding portion, the distance between the tips of the engaging arm of each forked contact member is increased by actions of a corresponding first plate cam, thereby increasing the distance between the upper arm and the lower arm of each of the forked contact members. Upon pressing down the holding portion after the insertion of the FPC, the distance between the tips of the engaging arm of each forked contact member is returned to the initial distance by actions of a corresponding first plate cam. At the same time, the upper arm and the lower arm of each forked contact member are returned to their initial states by the elasticity thereof. In this state, the FPC is held by the elastic force of the forked contact members, thereby maintaining the connection state of the FPC. With such an arrangement, upon raising the holding portion, the distance between the upper arm and the lower arm of each forked contact member is increased. Making the distance greater than the thickness of the FPC to be inserted into the space between the upper arms and the lower arms of the forked contact members, it enables the insertion and extraction of the FPC with a slight application of force. Thus, a quick connection of an FPC by operating the lever alone is achieved. Furthermore, the operation for connecting the FPC becomes simpler regardless of the number of the contact terminals.

With such an arrangement, the FPC is held by the elastic force of the upper arms of the forked contact members, thereby maintaining the connection state thereof. Thus, no external stress is applied to each forked contact member during this state. This provides the advantage of preventing deterioration in the durability of the forked contact members due to creep, for example. That is to say, no external stress is applied to each forked contact member during connection of the FPC to the connector, thereby improving the durability of the forked contact members thereof.

Furthermore, the forked contact member has a two-layer structure in which the upper arm and the lower arm are formed with one above the other. This provides the forked contact member with a reduced height. Thus, this enables the height of the connector to be reduced.

Furthermore, with such an arrangement, the contact tab, which is provided for connecting the forked contact member to a printed board, is disposed in front of the lower arm of each forked contact member. This. enables easily holding the holding portion during the lever opening and closing operation without interference from the contact tabs and so forth. This facilitates the lever opening and closing operation.

Furthermore, with such an arrangement, a pair of connection tabs is embedded in both side ends of the housing. Furthermore, the pair of connection tabs holds the rotational shaft through both ends thereof. Such an arrangement allows turning the lever as desired with the rotational shaft as a rotational axis while preventing disengagement of the lever from the housing, thereby improving ease of use.

Furthermore, the second plate cams are formed around the rotational shaft. The second plate cams are provided such that they are attached to the housing when the lever is in the closed state, thereby stably maintaining the state in which the lever is closed. An arrangement employing such a connector has the advantage of preventing undesirable rising of the lever, thereby maintaining the connection state of the FPC, for example.

Furthermore, the rotational shaft of the lever is formed of rigid metal. This enables the lever to be raised and lowered through the holding portion while suppressing deflection of the rotational shaft.

Furthermore, the first plate cams and the second plate cams are alternately disposed along the rotational shaft of the lever, in addition, the second plate cams are provided so as to be attached to the housing. This enables the lever to be raised and lowered through the holding portion while suppressing deflection of the rotational shaft.

Figure 1:
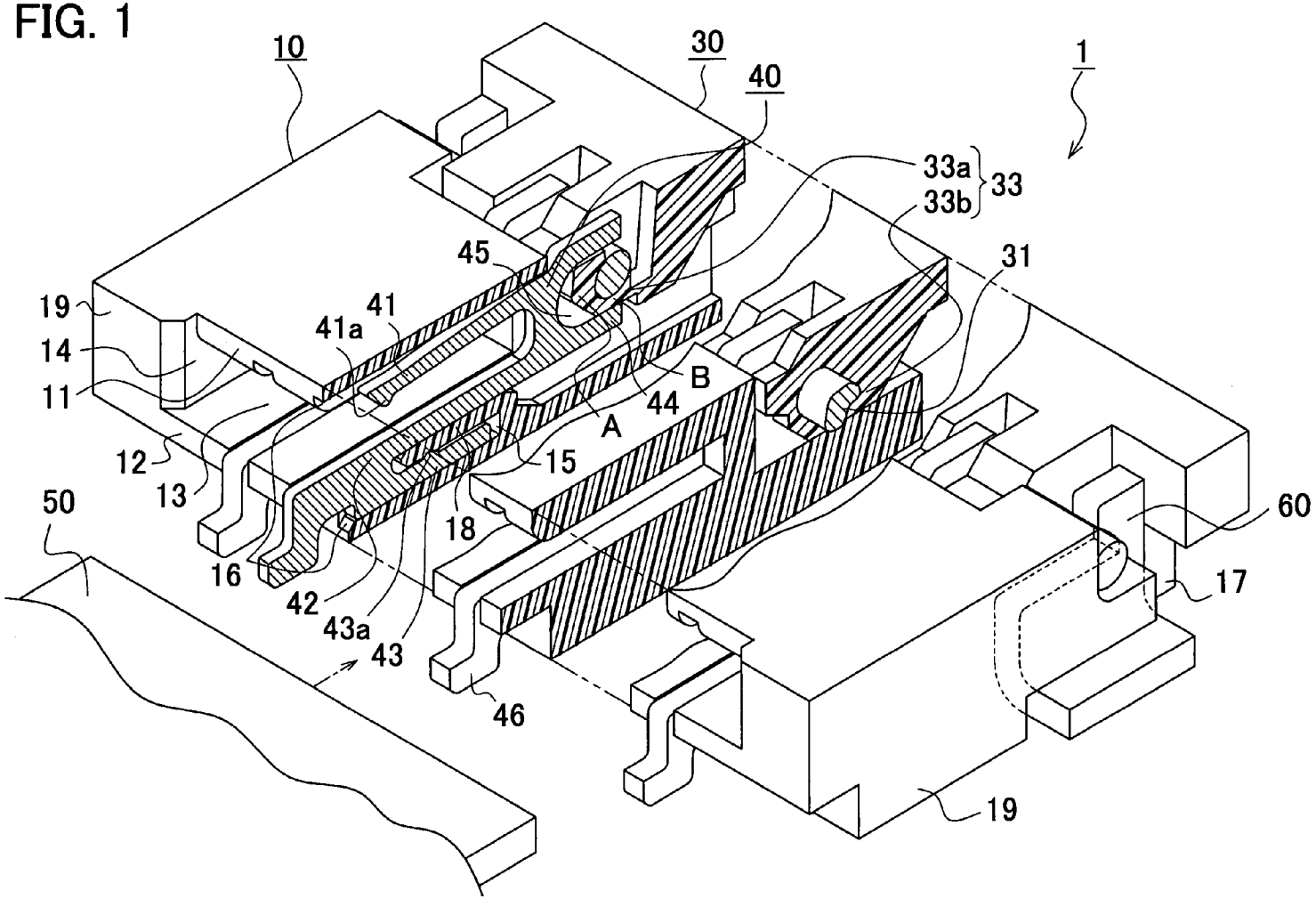
FIG. 1 is a perspective view of a structure of a connector according to an embodiment of the present invention, and shows cross-sections of the principal components.

| Reference Numerals | |
|---|---|
| 1 | connector |
| 10 | housing |
| 13 | opening |
| 17 | upper open end portion |
| 19 | both ends |
| 30 | lever |
| 31 | rotational shaft |
| 32 | holding portion |
| 33 | plate cam |
| 33a | first plate cam |
| 33b | second plate cam |
| 40 | forked contact member |
| 41 | upper arm |

-continued

| Reference Numerals | |
|---|---|
| 42 | lower arm |
| 44 | engaging arm |
| 45 | notch |
| 50 | FPC |
| 60 | connection tab |

PREFERRED MODE FOR CARRYING OUT THE INVENTION

Description will be made below regarding an embodiment according to the present invention.

Figure 2:
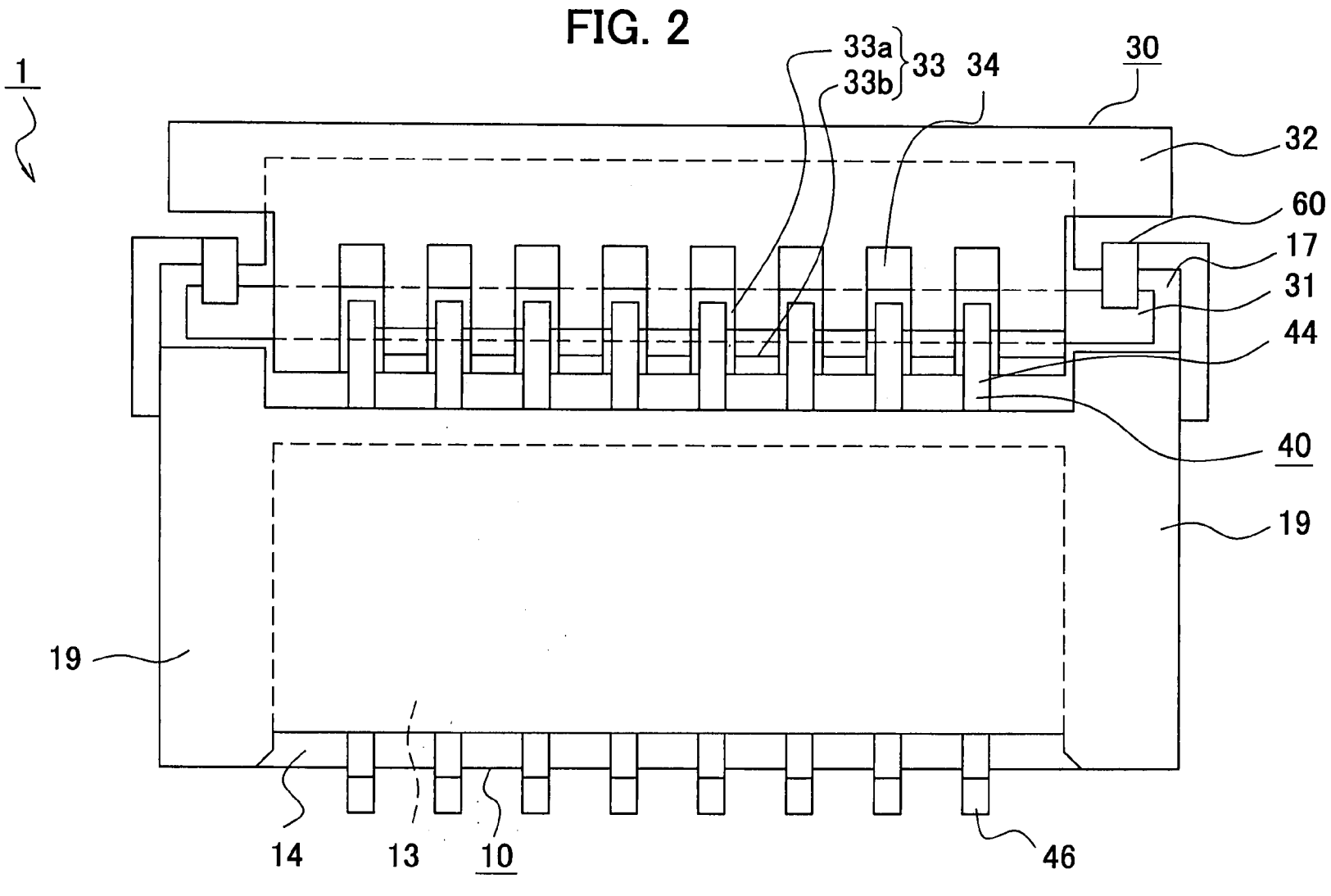
FIG. 2 is a plan view of the connector according to the present invention.
Figure 3:
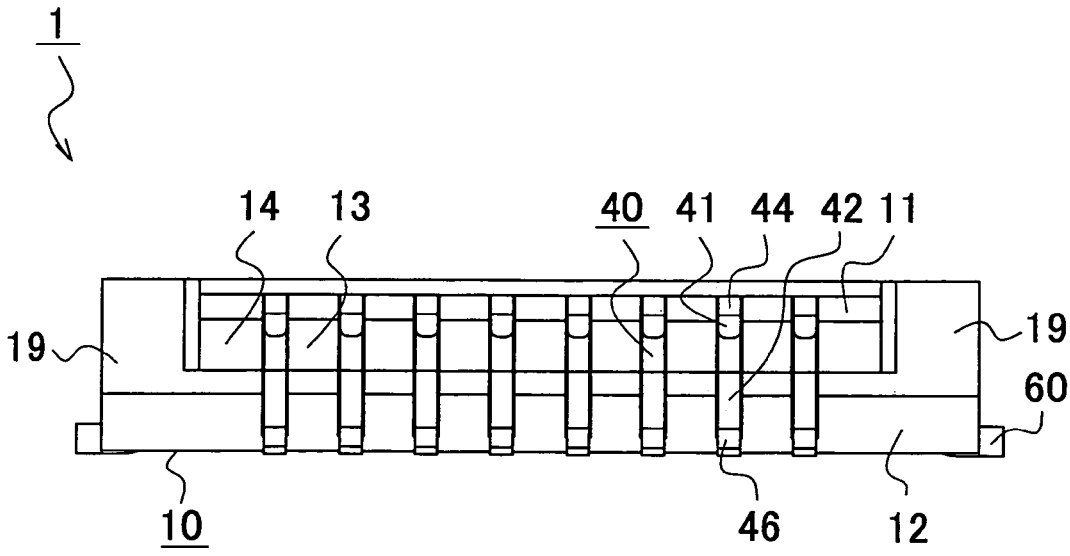
FIG. 3 is a front view of the connector according to the present invention.
Figure 4:
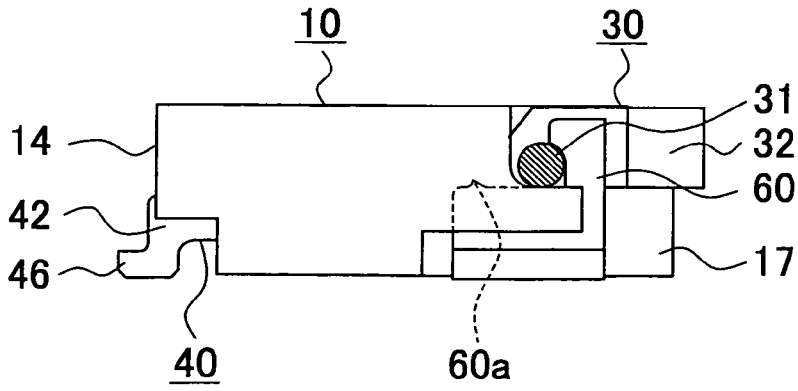
FIG. 4 is a side view of the connector according to the present invention.
Figure 5A:
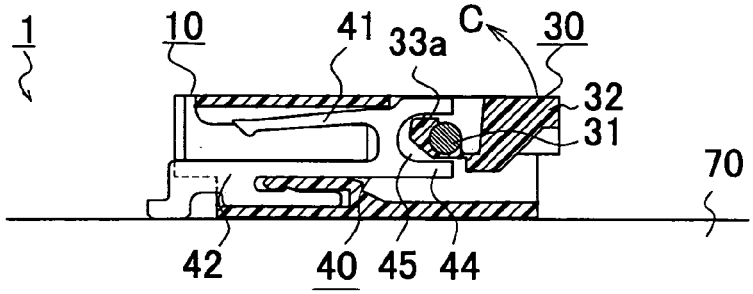
FIG. 5 is a diagram for describing an operation procedure for connecting an FPC to the connector according to the present invention wherein FIG. 5(*a*) is a diagram showing the connector connected to a printed board with a lever in the closed position, FIG. 5(*b*) is a diagram showing the connector with the lever having been opened, FIG. 5(*c*) is a diagram showing the connector with an FPC having been inserted thereinto, and FIG. 5(*d*) is a diagram showing the connector having been connected to the FPC with the lever having been closed.
Figure 5B:
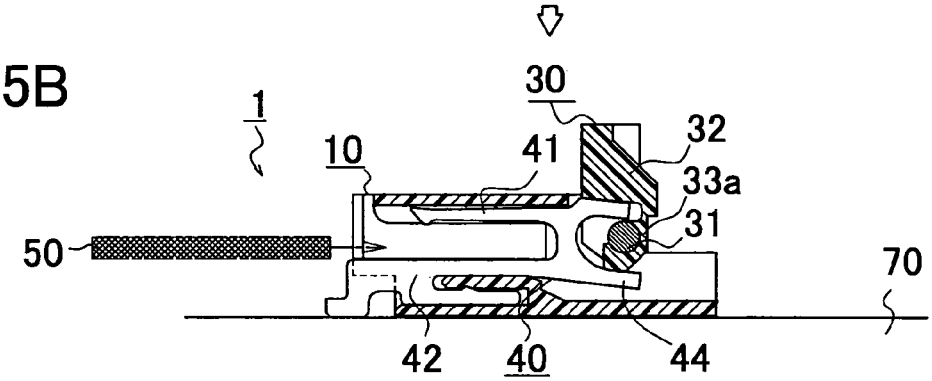
Figure 5C:
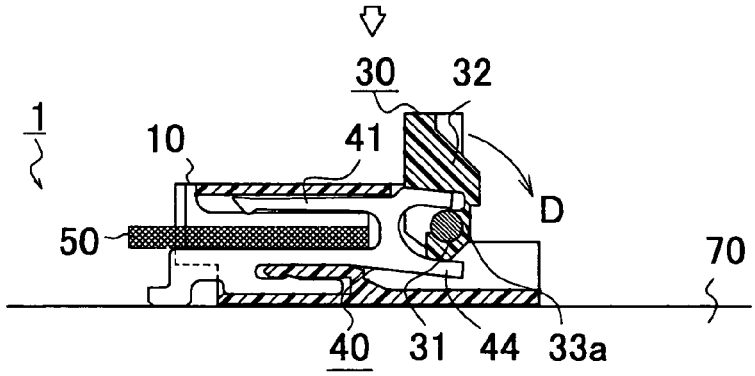
Figure 5D:
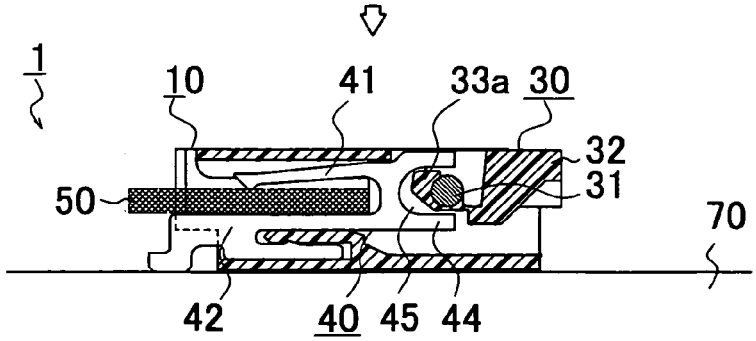
Figure 6:
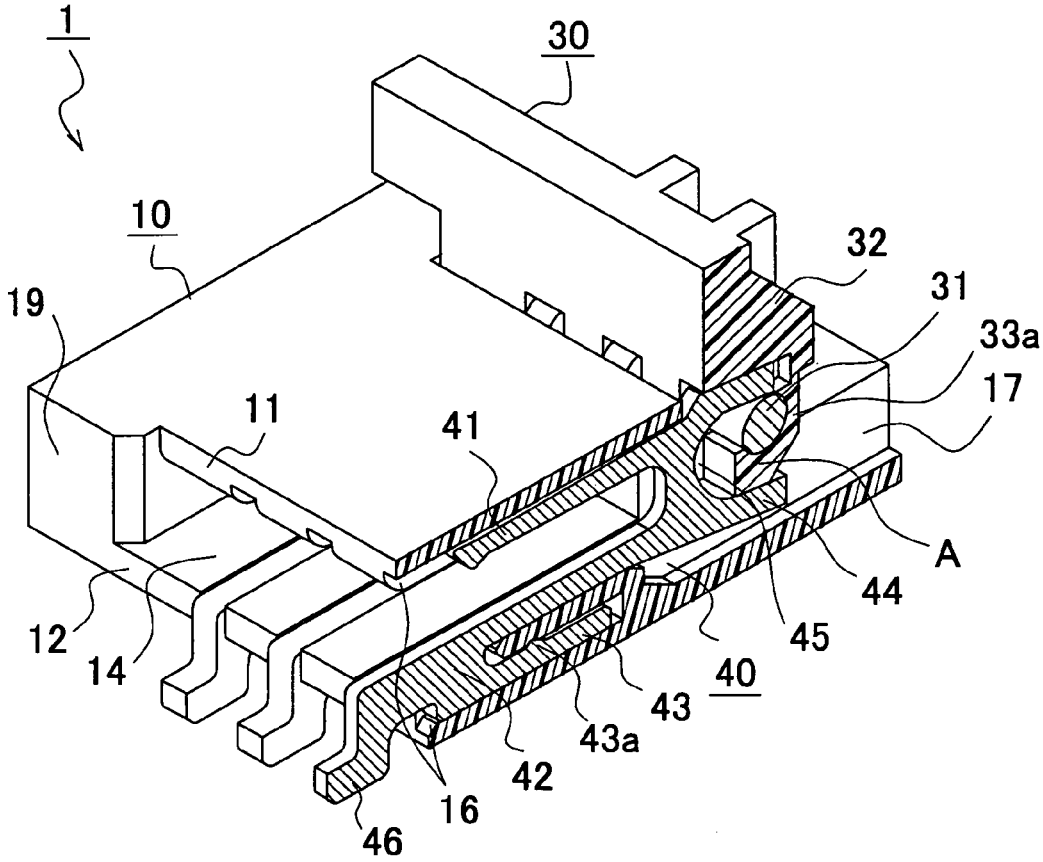
FIG. 6 is a perspective view of the connector according to the present invention, and is a partial cut-away perspective view of the connector before connection of the FPC.
Figure 7:
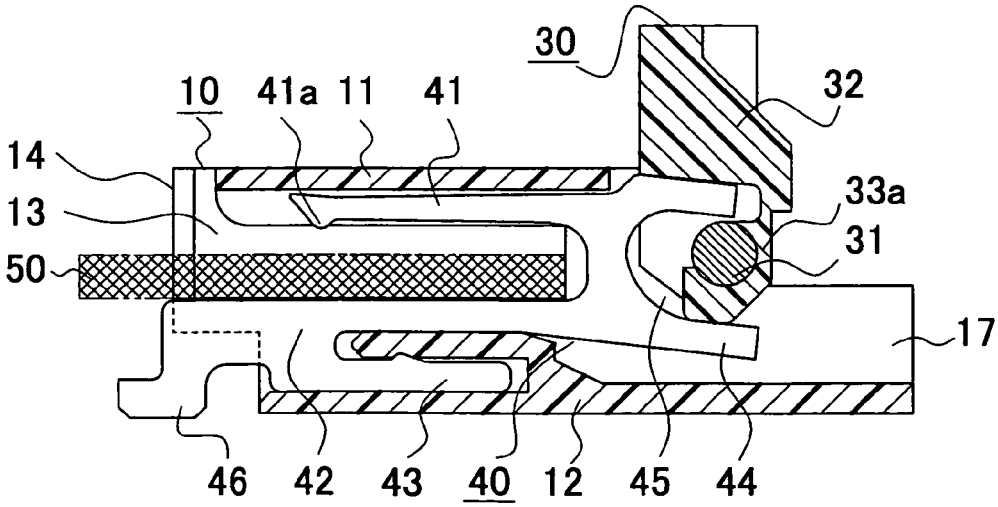
FIG. 7 is a longitudinal cross-sectional view of the connector shown in FIG. 6.
Figure 8:
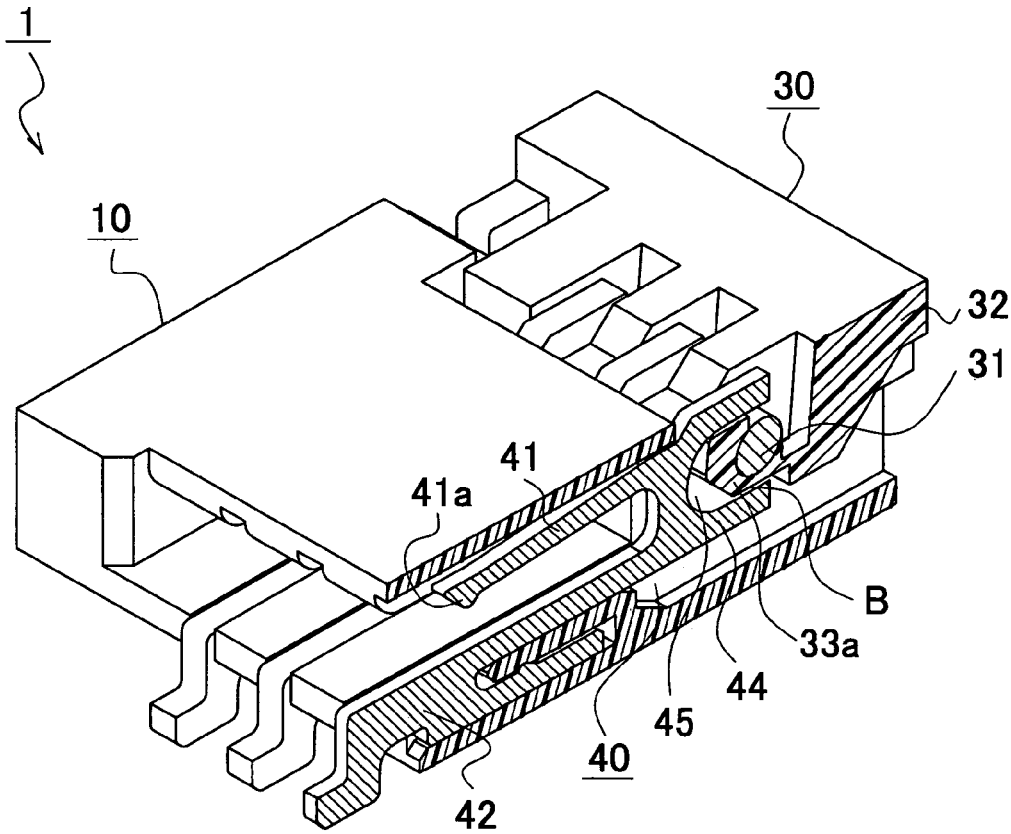
FIG. 8 is a perspective view of the connector according to the present invention, and is a partial cut-away perspective view of the connector in a state in which an FPC is being connected to the connector.
Figure 9:
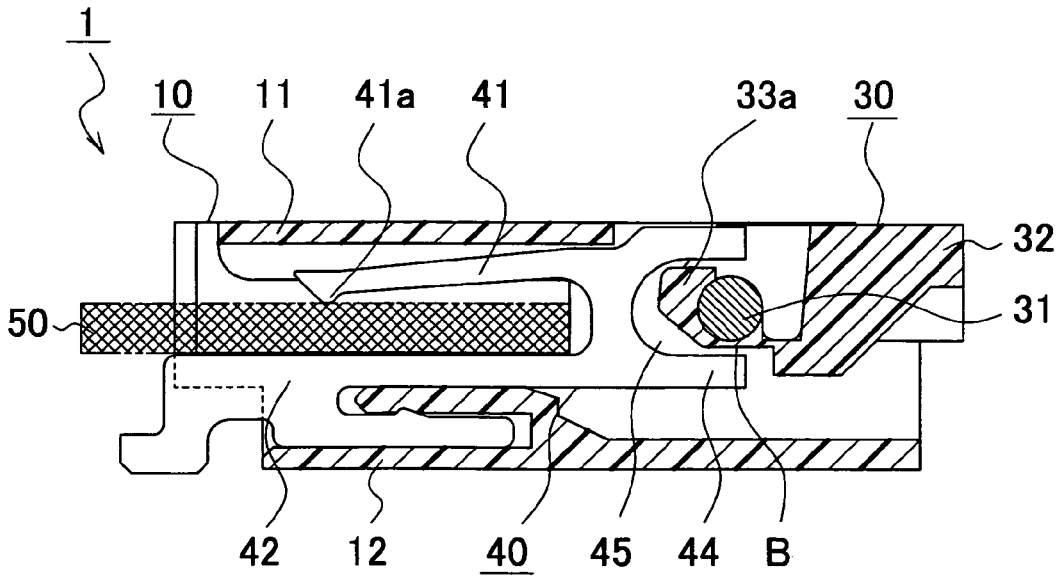
FIG. 9 is a longitudinal cross-sectional view of the connector shown in FIG. 8.

FIG. 1 is a perspective view of a structure of a reduced height connector (which will be simply referred to as "connector" hereinafter) according to an embodiment of the present invention, and shows cross-sections of the principal components. FIG. 2 is a plan view of the connector according to the present invention. FIG. 3 is a front view of the connector according to the present invention. FIG. 4 is a side view of the connector according to the present invention. FIG. 5 is a diagram for describing an operating procedure for connecting an FPC to the connector according to the present invention. FIG. 5(*a*) is a diagram which shows the connector fixed to a printed board, with the lever in the closed state. FIG. 5(*b*) is a diagram which shows the connector with the lever having been opened. FIG. 5(*c*) is a diagram which shows the connector with the FPC having been inserted. FIG. 5(*d*) is a diagram which shows the connector with the inserted FPC having been connected thereto with the lever having been closed. FIG. 6 is a perspective view of the connector according to the present invention, and is a partial cut-away perspective view of the connector before connection of the FPC. FIG. 7 is a longitudinal cross-sectional view of the connector shown in FIG. 6. FIG. 8 is a perspective view of the connector according to the present invention, and is a partial cut-away perspective view of the connector with an FPC having been connected to the connector. FIG. 9 is a longitudinal cross-sectional view of the connector shown in FIG. 8. Note that in these drawings, the scale is adjusted as appropriate for convenience of description.

Description will be made regarding a connector according to an embodiment of the present invention with reference to FIGS. 1 through 4.

In the connector shown in FIGS. 1 through 4, a housing 10 is formed of insulating plastic (synthetic resin). A connector 1 includes the housing 10 and a back lock lever 30 turnably mounted thereon. Furthermore, multiple forked contact members 40 are disposed on the housing 10 at a predetermined pitch. Each of the forked contact members 40 is formed by fine blanking of a metal film, for example.

The housing 10 includes an upper wall 11 and a lower wall 12 forming an opening 13 for the insertion of an FPC 50. Furthermore, the multiple forked contact members 40 are provided within the opening 13. Multiple grooves 16 are formed at a predetermined pitch in the inner wall of the opening 13, parallel to the insertion direction of the FPC 50. With such a structure, multiple forked contact members 40 are mounted in these grooves 16.

As shown in FIGS. 1 through 4, an insertion opening 14 is formed before the opening 13 for the insertion of the FPC 50. The insertion opening 14 allows the insertion of the connection terminal of the FPC 50 which is to be connected.

Furthermore, the lower wall 12 includes grooves 16 formed therein, for mounting lower arms 42 as shown in FIGS. 1 and 6.

Furthermore, a partition 18 is formed above the lower wall 12 for each groove 16, such that it extends forward from approximately the center. This forms an insertion hole 15 having an approximately U-shaped cross-section for the insertion of a fixing arm 43 of the lower arm 42 of each forked contact member 40. There is a space underneath each engaging arm 44. This enables the engaging arm 44 to be bent.

The rear side of the housing 10 (the right side shown in FIGS. 1 and 4) has a structure having no upper wall 11, and will be referred to as "upper open end portion" 17 hereafter. The upper portion of the upper open end portion 17 stores a back lock lever 30 turnably mounted thereon. Note that the upper face of the housing 10 is approximately level with that of the lever 30. The lever 30 serves as a cover member which covers the rear side of the housing 10.

On the other hand, each of both side ends 19 of the housing 10 has an opening (not shown) formed such that it extends forward from the rear side. Such a structure allows an approximately L-shaped metal connection tab 60 to be inserted into each of the pair of openings from the rear side of the housing 10 (from the side of the upper open end portion 17) toward the insertion opening 14 on the front side.

Each connection tab 60 has a sideways portion which is to be fixed to a printed board (not shown) by soldering, by which the housing 10 is fixed to the printed board. Furthermore, the upper portions of the connection tabs 60 turnably hold a rotational shaft 31 of the lever 30. Note that each connection tab 60 has a small protrusion 60*a*. Upon pressing the connection tab 60 such that it becomes inserted into the housing 10, the small protrusion 60 is fit to the housing 10, thereby fixing the connection tab 60 to the housing 10 (see FIG. 4).

As shown in FIG. 1, each forked contact member 40 includes an upper arm 41 and a lower arm 42. The lower arm 42 has a fixing arm 43 which extends backward along the lower wall 12 of the housing 10.

Furthermore, a forked engaging arm 44, having an approximately U-shaped notch 45, protrudes to the rear side of the lower arm 42 (on the right side in FIGS. 1 and 4). The engaging arm 44 is provided at the rear end of the lower arm 42 as a cantilever, and formed integrally with the upper arm 41 and the lower arm 42.

Upon inserting each lower arm 42 along the groove 16 formed in the lower wall 12 of the housing 10, the fixing arm 43 is inserted into the insertion hole 15, whereby the forked contact member 40 is fixed within the housing 10. The lower arm is formed in the form of an approximately straight strip. Furthermore, a small protrusion 43*a* for being inserted into the insertion hole 15 is formed on the upper edge of the fixing arm 43 of the lower arm 42.

A contact tab 46 is formed on the lower side of the front end of each lower arm 42 so as to protrude toward the outside of the housing 10. Since the contact tabs 46 are formed on the front side of the housing 10, such an arrangement provides a space on the rear side of the upper open end portion 17 of the housing 10, where no component extends. This facilitates holding the holding portion 32 while the operation of the lever 30.

On the other hand, the upper arm 41 is connected to the engaging arm 44. Furthermore, the upper arm 41 is formed so as to extend downward and toward the front side (the side of the insertion opening 14) such that it faces and is oblique to the lower arm 42. With such a structure, the closer to the front side, the narrower the distance between the upper arm 41 and the lower arm 42. The upper arm 41 includes a contact point portion 41*a* at the tip thereof, which protrudes toward the inside of the connector (so as to face the lower arm 42).

With such a structure in which the upper arm 41 is formed oblique, there is a space between the tip of the upper arm 41 and the upper wall 11 of the housing 10. Such a structure allows the tip portion to be moved in the vertical direction.

The contact point portion 41*a* and the lower arm 42 are formed with a distance therebetween such that upon applying pressure to the FPC 50 so as to insert it into the connector, the connector holds the FPC 50 through the nip between the contact point portions 41*a* and the lower arm. That is to say, the contact point portion 41*a* and the lower arm 42 are formed with a somewhat smaller distance therebetween than the thickness of the connection terminal of the FPC 50.

Note that the thickness of the connection terminal of the FPC 50 is not restricted in particular. Rather, depending upon the usage of the connector 1 according to the present invention, for example, FPCs of connection terminals with thicknesses of 0.3 mm, 0.2 mm, and 0.12 mm are employed for digital cameras (DSC, DVC), cellular phones, etc.

Each forked contact member 40 is inserted from the insertion opening 14 formed on the front of the housing 10 toward the upper open end portion, whereby each forked contact member 40 is mounted to the corresponding groove 16. At this time, the fixing arm 43 of the lower arm 42 of the forked contact member 40 is fit to the corresponding insertion hole 15 of the housing 10. The forked contact member 40 is fixed to the insertion hole 15 with the small protrusion 43*a* formed on the upper edge of the fixing arm 43 fit to a partition 18 of the housing 10. This ensures insertion of the forked contact member 40 into the housing 10 to a predetermined insertion depth. Furthermore, such a structure prevents undesirable disengagement of the forked contact member 40 from the housing 10.

With such a structure in which these forked contact members 40 are so disposed, the upper arms 41 and the lower arms 42 are disposed within the opening 13 of the housing 10 so as to face the insertion opening 14. Each forked contact member 40 is fixed to the housing through the lower arm 42. This means that the forked contact member 40 can employ a two-layer structure in which the upper arm 41 and the lower arm 42 are formed with one above the other. This provides the forked contact member 40 with a reduced height, thereby enabling the height of the connector 1 to be reduced. Specifically, the height of the connector 1 can be set according to the thickness of the connection terminal of the FPC 50 to be inserted. For example, in a case that the height of the connection terminal of the FPC 50 to be inserted was 0.3 mm, the connector 1 could be formed with a mounting height of approximately 1.2 mm.

On the other hand, each contact tab 46 is disposed such that the bottom thereof is approximately level with the bottom face of the lower wall 12 of the housing 10. Furthermore, each contact tab 46 is disposed so as to protrude toward the outside of the housing 10. The contact tabs 46 are connected to a printed board (see FIG. 5) by soldering, thereby connecting the forked contact members 40 with the printed board. With such an arrangement, the contact tabs 46 are disposed so as to protrude toward the front side of the housing 10. This provides a space on the rear side of the upper open end portion 17 of the housing 10, which facilitates holding of the holding portion 32. This improves easy usage of the lever 30 even the height of the connector 1 is reduced.

Note that the multiple upper arms 41 of the forked contact members 40 do not need to be formed with the same length. For example, an arrangement may be made in which two types of upper arms 41 are provided with the length of one being greater than the length of the other. Furthermore, an arrangement may be made in which these two types of upper arms 41 are alternately provided, thereby forming a staggered array of contact points for the inserted FPC 50. With such a structure, the FPC 50 does not receive the contact stress along a single line (linear stress), thus presenting the advantage of enabling the FPC 50 to be inserted while preventing the buckling or folding thereof.

The lever 30 includes a rotational shaft 31 of a metal cylinder and a holding portion 32 of an insulating plastic in the shape of an approximately rectangular plate, which together form a single unit. The lever 30 is mounted on the upper face of the upper open end portion 17 on the rear side of the housing 10. Note that the rotational shaft 31 and the holding portion 32 may be formed as a single unit, subsequently, the exposed metal face of the rotation shaft 31 may be coated with an insulating film. Alternatively, the rotational shaft 31 may be coated with an insulating film beforehand. Subsequently, the rotational shaft 31 thus coated may be connected with the holding portion 32 so as to form a single unit. This improves the insulating performance of the connector.

The holding portion 32 has the same number of opening grooves 34 as the number of the forked contact members 40 like a comb. The opening grooves 34 are formed at the corresponding position as the grooves 16 formed in the housing 10, which enables the forked contact member 40 to be mounted while preventing the upper portion of engaging arm 44 thereof from coming in contact with the handle portion 32.

Furthermore, two types of plate cams, i.e., a first plate cam 33*a* and a second plate cam 33*b* are alternately disposed along the rotational shaft 31, serving as a compound plate cam 33. The first plate cam 33*a* is engaged with the forked engaging arm 44, thereby forming a cam arrangement. Note that the first plate cam 33*a* is formed in a shape having a thicker portion A serving as a cam follower for increasing the amount of lift and a thinner portion B serving as a cam follower for reducing the amount of lift.

As shown in FIG. 1, each first plate cam 33*a* is provided so as to be introduced in an approximately U-shaped notch 45 of the forked engaging arm 44. As shown in FIGS. 1 and 4, the lever 30 is turnably held with both ends of the rotational shaft 31 being interposed between by the ends of the connection tabs 60 and the upper open end portion 17 of the housing 10.

Furthermore, a second plate cam 33*b* is provided between the adjacent forked contact members 40. Upon pressing down the lever 30 such that it closes over the upper open end portion 17 formed on the rear side of the housing 10, each second plate cam 33*b* is attached to the upper face of the upper open end portion 17, as shown in FIG. 1.

With such a structure in which the lever 30 is mounted to the housing 10, each first plate cam 33*a* is engaged with the corresponding engaging arm 44, thereby forming a cam arrangement which engages each first plate cam 33*a* with a corresponding engaging arm 44 (see FIG. 1). Therefore, the position of the engaging arms 44 can be changed in turning the lever 30 by actions of the first plate cams 33*a*.

Upon pressing down the lever 30, the lever 30 is stored on the upper open end portion 17 of the housing 10 as shown in FIG. 1. In this state, the lever 30 is stored so as to cover the rear side of the housing 10, thus serving as a cover. Furthermore, in this state, since each second plate cam 33*b* is attached to the upper face of the upper open end portion 17, the lever 30 can be stably held on the upper open end portion 17.

The connector 1 according to the present invention is connected to the FPC 50 following an operation procedure shown in FIG. 5. FIG. 5 is a diagram for describing an operation procedure for connecting the FPC to the connector according to the present invention. As shown in FIG. 5(*a*), with the connector 1 according to the present invention, the contact tabs 46 and the connection tabs (not shown) of the connector 1 are fixed to a printed board 70 by soldering, thereby fixing the connector 1 to the printed board 70. The connector 1 is connected to the printed board 70 in the state in which the lever 30 is closed (the lever is lying in the down position on the upper face of the upper open end portion 17 of the housing 10).

Next, when the FPC 50 is inserted, users raise the lever 30 holding the holding portion 32. Then the lever 30 turns in the direction of the arrow C (see FIG. 5(*a*)) with the rotational shaft 31 as an axis. As a result, the lever 30 comes to be in the open state (the lever is erected) as shown in FIG. 5(*b*). In this stage, the position of the upper arm 41 of each forked contact member 40 is shifted upward by actions of the cam arrangement formed of the plate cam 33*a* and the engaging arm 44 as described later, thereby increasing the distance between the upper arm 41 and the lower arm 42.

Next, the FPC 50 is inserted into the connector 1 in this state (see FIG. 5(*b*)). After the insertion of the FPC 50, the lever 30 is turned in the direction of the arrow D (see FIG. 5(*c*)) with the rotational shaft 31 as an axis such that the lever comes to be in the closed state as shown in FIG. 5(*d*). Thus, the FPC 50 is connected to the forked contact members 40 as described later.

Next, description will be made regarding connection of the FPC 50 to the connector 1 according to the present invention with reference to FIGS. 6 through 9.

FIGS. 6 and 7 show the connector 1 without an FPC 50 being connected thereto. As shown in FIGS. 6 and 7, upon turning the lever 30 such that it is raised to an approximately perpendicular position, i.e., the open state, the first plate cam 33*a* engaging with the approximately U-shaped notch 45 of each engaging arm 44 is turned, thereby moving downwards the thicker portion A. This movement of the thicker portion A presses down the engaging arm 44 of the forked contact member 40.

Upon pressing down the engaging arm 44, the upper arm 41 of each forked contact member 40 is elastically deformed such that the tip thereof is moved toward the upper wall 11 of the housing 10. This increases the distance between the contact point portion 41*a* formed at the tip of the forked contact member 40 and the lower arm 42. The contact point portion 41*a* and the lower arm 42 are designed such that the distance therebetween is greater than the thickness of the connection terminal of the FPC 50 when the engaging arm 44 of the forked contact member 40 is pressed down. Such a structure allows the insertion of the FPC 50 into the connector 1 without any stress.

Furthermore, there is a space underneath the holding portion 32 of the lever 30. This facilitates handling of the holding portion 32 when turning the lever 30 up, thereby allowing easy operation of the lever 30 by hand.

Next, upon turning the lever 30 down to an approximately horizontal position, i.e., the closed state, after the insertion of the FPC 50, as shown in FIGS. 8 and 9, each first plate cam 33*a* engaging with the approximately U-shaped notch 45 of the engaging arm 44 is turned, thereby turning the thicker portion A so as to face the insertion opening 14 (the left side in FIG. 9). After this action, the first plate cam 33*a* is situated such that the thinner portion B faces the engaging arm 44. This releases the force which has been applied to the engaging arm 44 so as to press down upon it.

This releases the force which has been applied to the upper arm 41 of each forked contact member 40, and which elastically deforms the tip thereof. Therefore, each upper arm 41 returns to an initial position, thereby returning the distance between each contact point portion 41*a* and the corresponding lower arm 42 to an initial distance.

The initial distance between each contact point portion 41*a* and the corresponding lower arm 42 is set beforehand to a smaller distance than the thickness of the connection terminal of the FPC 50 to be inserted. This enables the FPC 50 thus inserted to be held by the nip between the contact point portions 41 and the lower arms 42 while maintaining a connection therebetween. In this state, the upper arm 41 of each contact portion 40 is returned elastically. That is to say, external stress is not applied to any contact portion 42. This improves the durability of the connector.

With such a structure, in the state in which the lever is pressed down (closed) and each first plate cam 33*a* is situated such that the thinner portion B thereof faces the corresponding engaging arm 44, there is a space therebetween without connection. This prevents a short circuit while maintaining connection between the FPC 50 and each forked contact member 40.

Specific description has been made regarding the connector according to the present invention with reference to the drawings which show examples thereof. The present invention is not restricted to the examples shown in the drawings. Rather, it is to be understood that changes and modifications may be made as appropriate without departing from the technical scope of the present invention.

The invention claimed is:

1. A connector, comprising:

an approximately box-shaped housing having an insertion opening for the insertion of an FPC:

forked contact members provided within said housing: and a lever which is provided so as to face the insertion opening of said housing, and which is turnably held by said housing, wherein each forked contact member includes an upper arm and a lower arm extending approximately parallel with each other toward said insertion opening, and a forked engaging arm extending in a direction opposite to said insertion opening.

wherein said lower arm is held by said housing.

wherein said lever includes a holding portion, a rotational shaft which is provided to said holding portion and held by said housing, and first plate cams which are provided to said rotational shaft, each first plate cam being engaged with said engaging arm, and wherein, when said holding portion is raised, said forked engaging arm is deformed by said first plate cam, so as to increase a distance between the upper arm and the lower arm of each forked contact member, wherein said rotational shaft is formed of rigid metal, wherein said holding portion is formed of an insulating material, and wherein said rotational shaft and said holding portion is formed as a single unit.

2. A connector according to claim 1, wherein said housing includes a pair of connection tabs to be connected to a printed board, the pair of connection tabs being disposed on both sides of the housing so as to support both ends of the rotational shaft turnably.

3. A connector according to claim 1, wherein there is a space around said holding portion of said lever, which enables said holding portion to be held by hand.

4. A connector according to claim 2, wherein said lever includes second plate cams which are provided to said rotational shaft so as to engage with said housing.

5. A connector according to claim 1, wherein said lever includes second plate cams which are provided to said rotational shaft so as to engage with said housing.

6. A connector according to claim 4, wherein said first plate cams and said second plate cams are alternately disposed along an axial direction of said rotational shaft.

7. A connector according to claim 5, wherein said first plate cams and said second plate cams are alternately disposed along an axial direction of said rotational shaft.

* * * * *